US007410052B2

(12) United States Patent
Cook et al.

(10) Patent No.: US 7,410,052 B2
(45) Date of Patent: Aug. 12, 2008

(54) TRIAL KIT FOR DISPENSING TOILET PAPER AND MOIST WIPES

(75) Inventors: James Jeffrey Cook, Appleton, WI (US); Richard Stephen Holschuh, Appleton, WI (US); Craig William Kirouac, Appleton, WI (US); Benjamin Charles Sarbo, Winneconne, WI (US); Heather Anne Sorebo, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 294 days.

(21) Appl. No.: 11/250,967

(22) Filed: Oct. 14, 2005

(65) Prior Publication Data

US 2007/0084737 A1 Apr. 19, 2007

(51) Int. Cl.
*B65D 71/00* (2006.01)
*B65H 1/00* (2006.01)
*B65H 49/38* (2006.01)

(52) U.S. Cl. ..... 206/233; 206/494; 221/34; 242/594.5; 242/598.5

(58) Field of Classification Search ..... 206/223, 206/494, 389, 409, 497, 233; 242/55.2, 55.53, 242/598.3, 598.5, 594, 594.5; 221/33–68, 221/199
See application file for complete search history.

(56) References Cited

U.S. PATENT DOCUMENTS 2,564,539 A * 8/1951 Lucan ..... 242/598.6
4,010,914 A * 3/1977 Kowalski ..... 242/137.1
4,106,616 A * 8/1978 Boone ..... 206/233
4,387,832 A * 6/1983 Margulies ..... 221/63
4,483,491 A * 11/1984 Rainey ..... 242/598.3
4,978,095 A * 12/1990 Phillips ..... 206/233
5,311,986 A 5/1994 Putz
5,618,008 A * 4/1997 Dearwester et al. ..... 242/598.5
6,047,920 A * 4/2000 Dearwester et al. ..... 242/594.5
6,899,250 B2 * 5/2005 FitzSimons et al. ..... 221/45
6,929,154 B2 * 8/2005 Grey et al. ..... 222/153.03
7,185,841 B2 * 3/2007 Kaufmann ..... 242/564.4
7,293,738 B2 * 11/2007 Grebonval et al. ..... 242/597.7
2002/0108962 A1 * 8/2002 Mangin ..... 221/63
2003/0116464 A1 6/2003 Koenig et al.
2004/0130245 A1 * 7/2004 Pinto ..... 312/34.23
2004/0251292 A1 * 12/2004 Grebonval et al. ..... 206/409
2005/0133387 A1 6/2005 Cohen et al.
2005/0139719 A1 6/2005 Grebonval et al.

FOREIGN PATENT DOCUMENTS

CH 679114 A5 * 12/1991
GB 2 252 954 A 8/1992

* cited by examiner

*Primary Examiner*—Byron P Gehman
(74) *Attorney, Agent, or Firm*—Gregory E. Croft

(57) ABSTRACT

A portable free-standing kit which can serve as a functional trial product, particularly for children, includes a combination of dry toilet paper and moist wipes. A roll of toilet paper is rotatably mounted on a functional spindle housed within the kit. The moist wipes are provided in a container which is supported by either a shelf or the bottom of the kit.

11 Claims, 3 Drawing Sheets

TRIAL KIT FOR DISPENSING TOILET PAPER AND MOIST WIPES

BACKGROUND OF THE INVENTION

Teaching children to properly clean themselves after a bowel movement is a constant challenge for parents. While many children learn to clean themselves using dry toilet paper, the use of moist wipes in conjunction with dry toilet paper has been largely ignored. Since the combined use of dry toilet paper and moist wipes provides the best cleaning, there is a need for a means of making both products conveniently available to children and to encourage proper usage.

SUMMARY OF THE INVENTION

It has now been discovered that helping children to wipe effectively can be enhanced by providing a portable, free-standing kit that contains a functioning roll of toilet paper and a container of moist wipes. The kit can be placed on the floor of the bathroom, or any other convenient surface such as a counter top or toilet tank cover, and may be moved during or after use as desired. The toilet paper, the moist wipes, the moist wipes container and the kit package can be provided with suitable graphics/colors that appeal to children and encourage them to properly use the products. At the same time, particularly for households in which the child shares a bathroom with adults, the kit eliminates any need to change the regular toilet paper or wipes used by adults with products that appeal to children.

Hence, in one aspect the invention resides in a portable free-standing kit comprising a package structure, a container of moist wipes securely positioned within the package structure for dispensing moist wipes, and at least one roll of toilet paper rotatably mounted within the package structure for dispensing sheets of toilet paper. The relative positions of the moist wipes container and the roll of toilet paper within the package structure can vary. In one embodiment, the container of moist wipes can be on top and the roll of toilet paper can be on the bottom. In another embodiment, the container of moist wipes can be on the bottom and the roll of toilet paper can be on the top. In yet another embodiment, the container of moist wipes and the roll of toilet paper can be side-by-side. In all of the foregoing embodiments, the axis of rotation of the roll of toilet paper can be oriented vertically or horizontally.

In a more specific aspect, the invention resides in a portable free-standing kit comprising a package structure, a container of moist wipes securely positioned within the package structure for dispensing moist wipes and a roll of toilet paper rotatably mounted within the package structure for dispensing sheets of toilet paper, said package structure comprising a back wall, two opposing outer sidewalls, two opposing inner sidewalls, a bottom and a shelf which supports the container of moist wipes, wherein the roll of toilet paper is rotatably mounted on a horizontal spindle having ends supported by openings in the inner sidewalls above the bottom and below the shelf.

In another more specific aspect, the invention resides in a portable free-standing kit comprising a package structure, a container of moist wipes securely positioned within the package structure for dispensing moist wipes and a roll of toilet paper rotatably mounted within the package structure for dispensing sheets of toilet paper, said package structure comprising a back wall, two opposing outer sidewalls, two opposing inner sidewalls, and a bottom which supports the container of moist wipes, wherein the roll of toilet paper is rotatably mounted above the container of moist wipes on a horizontal spindle having ends supported by openings in the inner sidewalls.

As used herein, the container of moist wipes can be any container, including flexible containers, such as refill bags, which are of a size which fits into the space allotted for the moist wipes in the package structure. Most conveniently, the container of moist wipes can be a generally rectangular rigid tub having a hinged top lid for pop-up dispensing, which is the easiest method of dispensing for children. Moist wipe containers having a push-button lid opening feature are particularly advantageous.

The roll of toilet paper is rotatably mounted within the package structure so that the roll is functional and the toilet paper can be dispensed. The roll can be vertically oriented or horizontally oriented. For horizontal orientations, the use of a spindle with its ends supported by the opposing side walls of the package structure is particularly advantageous because of its smooth and reliable operation. However, the spindle can be replaced by suitable inwardly extending protrusions from the inner surface of the sidewalls that engage the ends of the toilet paper roll and still allow rotation of the roll for dispensing. Similarly, when a vertical orientation of the toilet paper roll is desired, a vertically extending protrusion from either the bottom of the package structure or from the shelf can be provided, provided the roll of toilet paper rotates freely to dispense the sheets. Alternatively for vertical orientation of the toilet paper roll, holes can be provided in the surfaces of the package structure above and below the roll to receive and hold the ends of the spindle as can be done with the horizontal orientation.

The moist wipes container is securely mounted within the package so that it does not slide out when the kit is tilted. Since the kit is portable, this can be particularly important when the kit is being transported. While any means for securing the container can be used, such as adhesive tapes, recessed support surfaces and/or inner sidewall protrusions, an advantageous means for securing the container is a vertical flap or lip on or near the front of the bottom surface or the shelf, depending on the location of the moist wipes container. The width of the vertical flap can be any width that serves its purpose, but suitably its width can be at least one third of the width of the opening. To the extent it is shorter than the opening width, the vertical flap should be centered within the opening. The height of the vertical flap can be any height that prevents the container from sliding out of the kit. Preferably it is low enough to avoid covering the graphics on the front side of the container. A suitable height range is from about 10 to about 25 millimeters, more specifically about 15 to about 20 millimeters. The height can vary along the width of the vertical flap, such as being higher at the ends and lower in the middle, particularly to accommodate viewing any graphics on the container.

In order to promote portability, a carrying handle can be included in the kit. Particularly suitable carrying handles include a strap attached to the upper portion of the package structure or an opening in the top of the back wall or in either or both of the sidewalls of the package structure that is large enough to insert one's fingers.

It is particularly advantageous for the kit to comprise a removable front panel in front of the roll of toilet paper. This panel not only protects the roll of toilet paper, but also provides a surface for attractive or informative graphics. While the panel is removable, it can also be left in place during use if it is provided with an optional open window through which the sheets of toilet paper can be unwound and removed.

The sidewalls of the package structure can be enhanced by providing inner sidewalls spaced inwardly from the outer sidewalls. This provides a convenient and solid means for supporting the ends of the spindle without creating a hole in the outer sidewalls and exposing the ends of the spindle. This feature is further illustrated in FIGS. 1 and 2.

The material used to construct the package structure of the kit is preferably paperboard, although various plastic materials could also be used. Paperboard is relatively inexpensive and sufficiently durable for the limited use of the kit, which can be treated as being disposable. However, the package structure is sufficiently-durable to be used repeatedly by replacing the toilet paper and the container of wet wipes, particularly since the kit is preferably provided with a removable spindle. As used herein, "paperboard" includes any relatively stiff sheet of material made of papermaking fibers, including corrugated board, cardboard and the like.

The bottom and/or the sides or back of the package structure can advantageously be water-resistant since the kit may be placed on the bathroom floor near the toilet or sink. Providing water resistance can be accomplished by many ways known to those skilled in the packaging arts, such as by the use of a sizing agent, either by incorporating a sizing agent into the pulp fiber furnish prior to forming the paperboard sheet or treating the surface of the paperboard sheet with a sizing agent after it is formed. Alternatively, the surface of the paperboard can be post-treated with a water-resistant coating or film. Suitable water-resistant materials include a wide variety of polymers including, for example, polyethylene, polypropylene, polystyrene, polyester, wax and the like.

A desirable feature of the kit of this invention includes coordinating graphics for the toilet paper, the moist wipes and/or the moist wipes container and the package structure. As used herein, the term "coordinating" means that the subject matter of the graphics is related in some way, particularly in the eyes of a young child. Typically, the graphics are coordinated if they share a common theme, such as a water theme, a jungle theme, mystery theme, particular cartoon theme, etc. A particular example would be puppies and paw prints on the toilet paper and playing puppies embossed into the moist wipes. Other examples include, without limitation: a road leading to a truck on the toilet paper and construction trucks with road signs embossed on the moist wipes; crowns and wands leading to princess on the toilet paper and a princess in various positions (sitting, standing, holding wand, crown on head) embossed on the moist wipes; lily pads leading to a frog on the toilet paper and leaping frogs playing with butterflies embossed on the moist wipes; animal prints (jungle or zoo) leading to an animal on the toilet paper and playing animals embossed on the moist wipes; musical notes leading to an instrument on toilet paper and different instruments with musical notes embossed on the moist wipes; dinosaur footprints leading to a dinosaur on the toilet paper and dinosaurs with caves embossed on the moist wipes.

Another desirable feature of the kit of this invention is that it be wrapped in a protective plastic material, especially a clear protective plastic such as shrink wrap, prior to being used. Such a material provides protection on the store shelf and during shipping, yet allows the purchaser to see the products inside. Prior to use, the plastic wrap is simply removed and the kit is immediately functional. Advantageously, the plastic wrap can expose the carrying handle to make it accessible at the store for easy carrying by the child.

The dimensions of the kit will vary somewhat depending on the size and number of toilet paper rolls included. Suitably, the height of the kit can be from about 12 to about 20 inches, the width can be from about 5 to about 15 inches and the depth can be from about 5 to about 10 inches. In a particular example of a kit containing a single roll of toilet paper and a single container of moist wipes as shown in FIGS. 1 and 2 herein, the height is 15.25 inches, the width is 6.75 inches and the depth is 5 inches.

DETAILED DESCRIPTION OF THE INVENTION

Referring to the figures, the invention will be further described. Like reference numbers in different figures refer to the same features.

Figure 1:
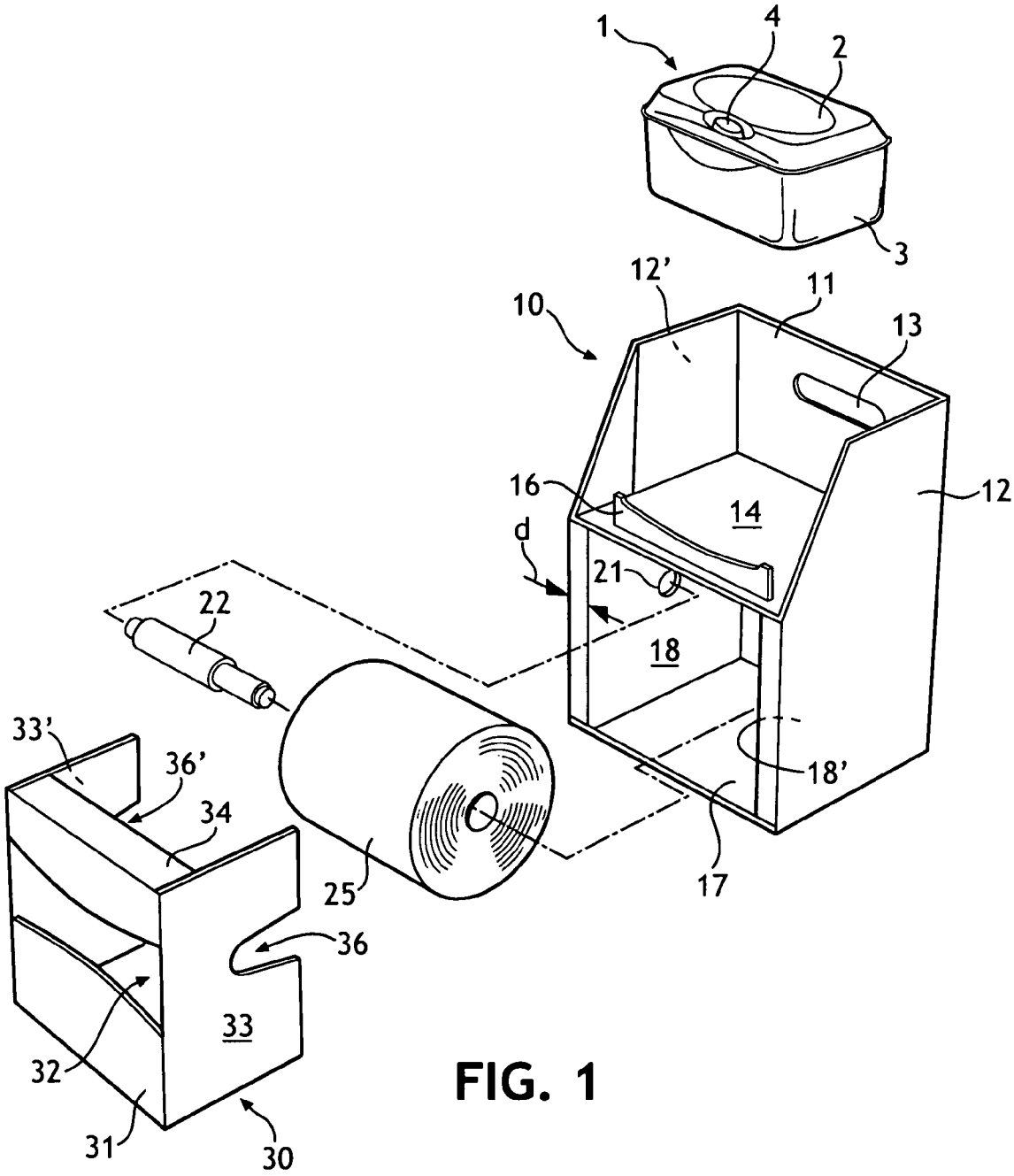
FIG. 1 is an expanded perspective view of the various components of a kit in accordance with this invention, illustrating its assembly.

Directing attention to FIG. 1, shown is a container of moist wipes 1 having a pop-up lid 2 and a base 3. The pop-up lid has a push-button 4 for easy opening of the lid to provide access to the wipes inside.

The paperboard package structure 10 of the kit includes a back wall 11, two opposing outer side walls 12 and 12', a carrying handle 13, a shelf 14 which divides the package structure into an upper compartment and a lower compartment and serves to support the container of moist wipes. Also shown is a vertical flap 16, which is formed by folding up a cut-out from the shelf, a bottom 17, inner sidewalls 18 and 18' present on both sides of the package (only inner sidewall 18 is visible in this view) separated from the outer side walls 12 and 12' by a distance "d", and a hole 21 for supporting the end of the spindle 22. As shown, the horizontally oriented roll of toilet paper 25 is mounted on the spindle and the spindle is inserted into the bottom compartment of the package structure to engage the two holes (one hole not visible in this view) in the opposing inner sidewalls (one inner sidewall not visible in this view).

Also shown is a removable front panel 30 which is inserted into the bottom compartment of the package structure to at least partially cover the roll of toilet paper. The removable front panel has a front surface 31, an optional open window 32, two side surfaces 33 and 33', a top flap 34 and a bottom flap (not visible in this view). The side surfaces have a cutouts 36 and 36' which accommodate the spindle and further provide stability to the position of the front panel. As previously noted, the front surface of the removable panel provides a convenient place for desirable graphics which can be for point-of-purchase purposes, in which case the panel can be removed, or for in-use purposes, in which case the panel can remain.

Figure 2:
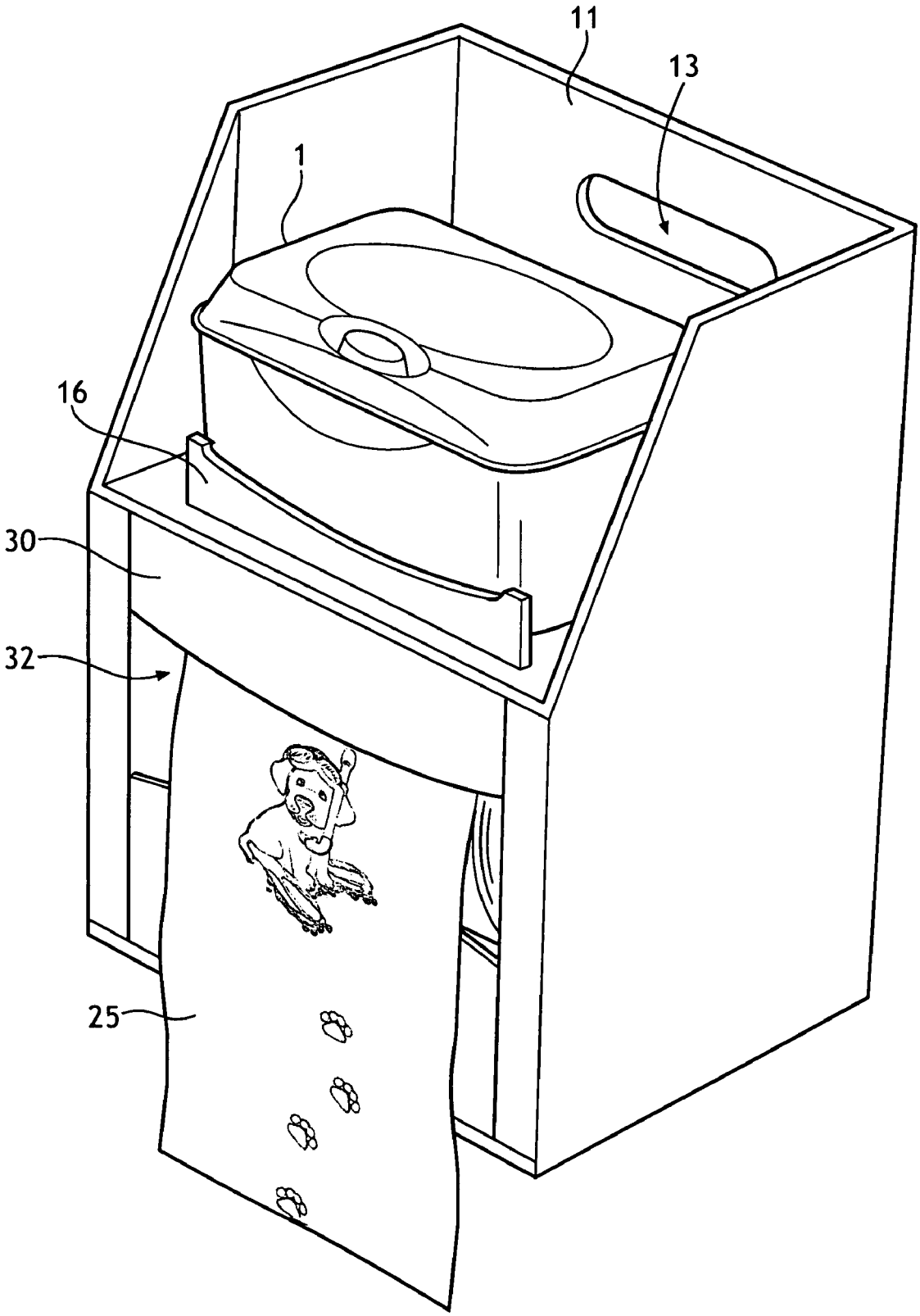
FIG. 2 is a perspective sketch of an unwrapped embodiment of a kit in accordance with this invention.

FIG. 2 is a perspective sketch of the assembled kit of this invention with the plastic wrap removed and the removable front panel 30 retained in place during use. As shown, the toilet paper 25 is removed through the open window 32 in the removable front panel. At the same time, the container of moist wipes 1 is readily available to the user and is secured by the presence of the vertical flap 16. The open front and top of the package structure enhances the ability to open the lid and remove the moist wipes. The hole 13 in the back wall provides a convenient carrying handle for the kit.

Figure 3:
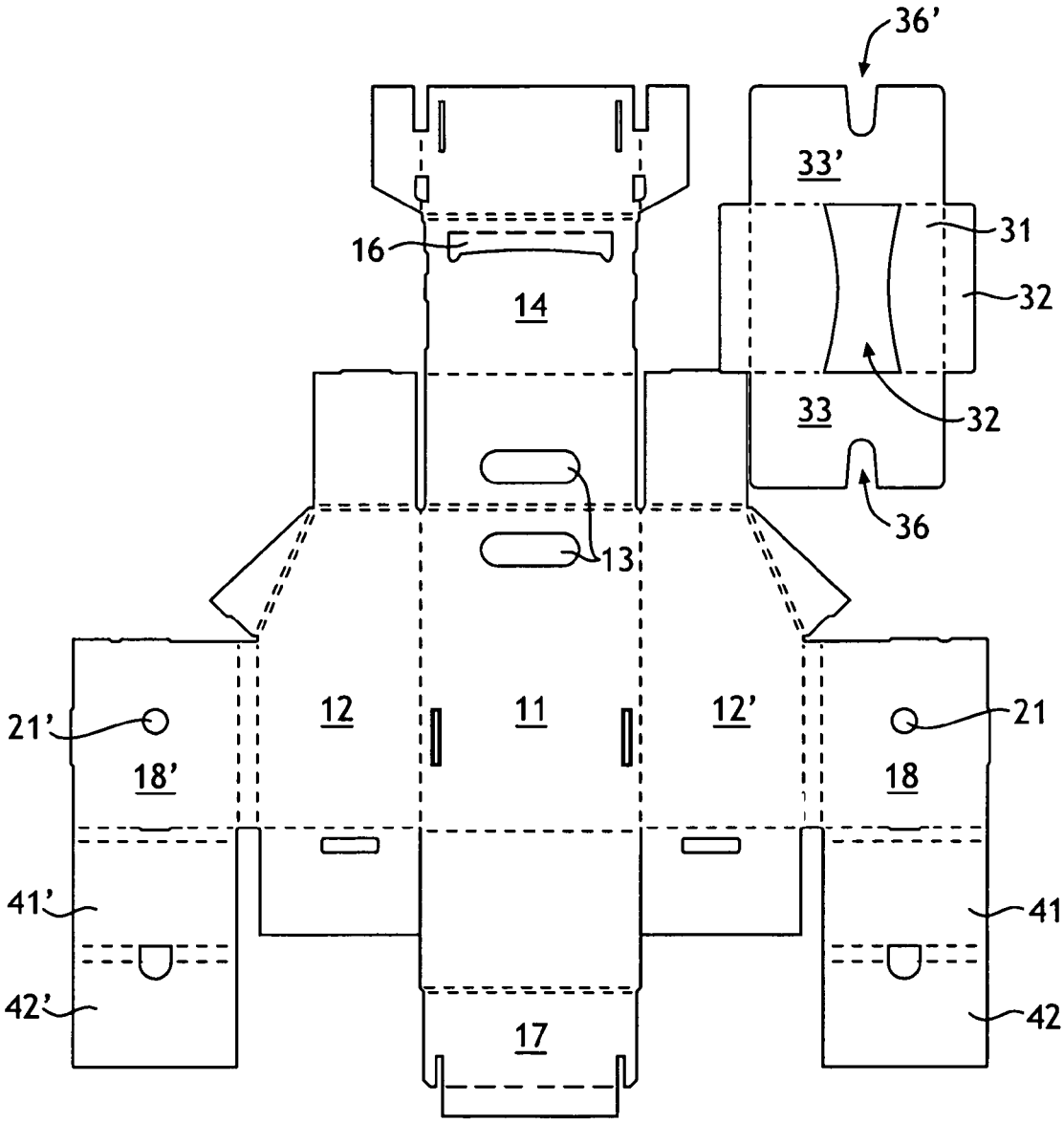
FIG. 3 is a plan view of a carton blank for the package structure illustrated in FIGS. 1 and 2.

FIG. 3 is a plan view of a carton blank for the package structure illustrated in FIGS. 1 and 2 with the outwardly-facing side that contains the graphics or printed matter of the kit is facing up. The panels labeled in FIGS. 1 and 2 are also identified in FIG. 3. Dashed lines indicate fold lines. Extra panels 41 and 42 and corresponding panels 41' and 42' provide added space and stiffness in the sidewalls to support the ends of the spindle when the package structure is assembled. To assemble the package structure from the blank as shown, the first step is to detach the portion of the blank corresponding to the removable front panel, which can be inserted after the package structure is loaded with the toilet paper roll and spindle. The remaining steps are as follows: Flip the carton blank over so that the graphics side is facing down. With the inwardly facing side of the blank now laying face up, fold up both side panels 90 degrees. Fold in the bottom flaps on the side panels 90 degrees. Fold the bottom panel inside the package structure to secure the bottom flaps. Fold each side flap on double score lines to create a side roll up. Fold the rolled up side panels inward 180 degrees and lock the tabs into the slots. Fold the rolled up side panels 180 degrees inward and lock the panels in the bottom/back tab slots. Fold the back panel down 180 degrees and backfold the shelf panel forward. Fold the shelf panel 180 degrees inward to create two layers. Side flaps flip upward 90 degrees. Fold the top side panels down 180 degrees and lock tabs into bottom slots. Fold the front angled side panels inward 180 degrees and lock tabs into bottom slots. The package structure is ready for loading product.

It will be appreciated the foregoing description and figures, given for purposes of illustration, are not to be construed as limiting the scope of the invention, which is defined by the following claims and all equivalents thereto.

We claim:

1. A portable free-standing kit comprising a package structure, a container of moist wipes securely positioned within the package structure for dispensing moist wipes and a roll of toilet paper rotatably mounted within the package structure for dispensing sheets of toilet paper, wherein the package structure comprises a back wall, two opposing outer sidewalk, two opposing inner sidewalls, a bottom and a shelf which supports the container of moist wipes, wherein the roll of toilet paper is rotatably mounted on a horizontal spindle having ends supported by openings in the inner sidewalls above the bottom and below the shelf, said kit further containing a removable front panel positioned to protect the roll of toilet paper.

2. A portable free-standing kit comprising a package structure, a container of moist wipes securely positioned within the package structure for dispensing moist wipes and a roll of toilet paper rotatably mounted within the package structure for dispensing sheets of toilet paper, wherein the package structure comprises a back wall, two opposing outer sidewalls, two opposing inner sidewalls, a bottom and a shelf which supports the container of moist wipes, wherein the roll of toilet paper is rotatably mounted on a horizontal spindle having ends supported by openings in the inner sidewalls above the bottom and below the shelf, said kit containing a removable front panel which contains an open window through which the toilet paper can be dispensed.

3. The kit of claim 1 or 2 where in said shelf has a vertical flap which prevents the container of moist wipes from sliding off of the shelf.

4. The kit of claim 1 or 2 having an opening in the back wall of the package structure above the shelf, said opening serving as a carrying handle.

5. The kit of claim 1 or 2 having an opening in either of the outer sidewalk of the package structure, said opening serving as a carrying handle.

6. The kit of claim 1 or 2 wherein the inner sidewalls have openings which support the ends of the spindle.

7. The kit of claim 1 or 2 wherein the package structure is made of paperboard.

8. The kit of claim 1 or 2 wherein at least one of the bottom and sides of the package structure is coated with a water resistant material.

9. The kit of claim 1 or 2 wherein the outer sidewalls and the back of the package structure rise above the container of wet wipes and wherein the package structure has an open front and an open top which provides easy access to the container of moist wipes.

10. The kit of claim 1 or 2 wherein the moist wipes, the toilet paper and the package structure have coordinating graphics.

11. The kit of claim 1 or 2 wrapped in protective plastic.

* * * * *